US009006988B2

(12) United States Patent
Zhang et al.

(10) Patent No.: US 9,006,988 B2
(45) Date of Patent: Apr. 14, 2015

(54) METHOD OF CONTROLLING IGNITION CIRCUIT AND IGNITION CIRCUIT USING THE SAME

(75) Inventors: Qi Zhang, Shanghai (CN); Weiqiang Zhang, Shanghai (CN); Jianping Ying, Shanghai (CN)

(73) Assignee: Delta Electronics, Inc., Taoyuan Hsien (TW)

( * ) Notice: Subject to any disclaimer, the term of this patent is extended or adjusted under 35 U.S.C. 154(b) by 861 days.

(21) Appl. No.: 13/168,437

(22) Filed: Jun. 24, 2011

(65) Prior Publication Data

US 2012/0098452 A1 Apr. 26, 2012

(30) Foreign Application Priority Data

Oct. 22, 2010 (CN) ..... 2010 1 0526990

(51) Int. Cl.
*H05B 41/36* (2006.01)
*H05B 41/04* (2006.01)

(52) U.S. Cl.
CPC ..... *H05B 41/042* (2013.01)

(58) Field of Classification Search
USPC ..... 315/209 R, 223, 224, 246, 276, 291, 315/307, 308
See application file for complete search history.

(56) References Cited

U.S. PATENT DOCUMENTS 4,472,661 A 9/1984 Culver
4,552,118 A 11/1985 Fukaya
6,008,591 A 12/1999 Huber et al.
6,046,551 A * 4/2000 Kita ..... 315/307
6,606,259 B2 * 8/2003 Cohen ..... 363/56.01
7,202,609 B2 * 4/2007 Langeslag et al. ..... 315/291

FOREIGN PATENT DOCUMENTS

| | | | |
|---|---|---|---|
| CN | 1279531 | A | 1/2001 |
| CN | 1092418 | C | 10/2002 |
| CN | 1013586861 | A | 1/2009 |
| EP | 0711038 | B1 | 3/2000 |
| JP | 9292859 | A | 11/1997 |
| KR | 20080086090 | A | 9/2008 |
| TW | 387643 | U | 4/2000 |
| TW | M251396 | U | 11/2004 |
| TW | I268124 | B | 12/2006 |
| WO | 2009087729 | | 7/2009 |
| WO | 2009096417 | | 8/2009 |

* cited by examiner

*Primary Examiner* — Douglas W Owens
*Assistant Examiner* — Thai Pham
(74) *Attorney, Agent, or Firm* — Kirton McConkie; Evan R. Witt

(57) ABSTRACT

A method of controlling an ignition circuit to output an excitation voltage is disclosed. The ignition circuit is used to excite a discharge lamp and includes a transformer and a switch element which is connected to a primary winding of the transformer. The method of controlling the ignition circuit comprises steps of: (a) receiving a control signal which is set in accordance with a waveform characteristic of a predetermined excitation voltage to control an impedance of the switch element; (b) controlling a primary current in the primary winding or a primary voltage across the primary winding of the transformer by controlling the impedance of the switch element; and (c) generating the excitation voltage by the secondary winding of the transformer in accordance with the primary current or the primary voltage so as to excite the discharge lamp.

17 Claims, 18 Drawing Sheets

METHOD OF CONTROLLING IGNITION CIRCUIT AND IGNITION CIRCUIT USING THE SAME

FIELD OF THE INVENTION

The invention relates to a control method, and more particularly to a control method for an ignition circuit and the ignition circuit applying such control method.

BACKGROUND OF THE INVENTION

High-intensity discharge (HID) lamp is featured by intense luminescence, long longevity, small size, and excellent illuminant efficiency. Thus, the High-intensity discharge lamps have been widely employed in outdoor situations or indoor situations, or used as the illuminating device for automobiles.

Generally, the high-intensity discharge lamp is mounted in a lamp seat that is durable under a high voltage of 5000V. Moreover, the high-intensity discharge lamp must be operated in cooperation with an electronic ballast. Referring to FIG. 1, which shows a circuit block diagram of a conventional electronic ballast. As shown in FIG. 1, the conventional electronic ballast 9 is used to excite the high-intensity discharge lamp Lp when the HID lamp is operating in the transient ignition stage, and provide a steady current for the high-intensity discharge lamp Lp when the high-intensity discharge lamp Lp is operating in the stable stage. The electronic ballast 9 includes a power circuit 90 and an ignition circuit 91. The power circuit 90 includes an AC/DC converter 900, a DC/DC converter 901, and an inverter 902. The AC/DC converter 900 is used to receive an AC voltage Vac and convert the AC voltage Vac into a first DC voltage V1'. The DC/DC converter 901 is used to convert the first DC voltage V1' into a second DC voltage V2'. The inverter 902 is used to convert the second DC voltage V2' into an operating AC voltage Vw' for powering the high-intensity discharge lamp Lp when the high-intensity discharge lamp Lp is operating in the stable stage.

Referring to FIGS. 2 and 1, in which FIG. 2 is a circuit diagram showing the circuit structure of the ignition circuit of FIG. 1. The ignition circuit 91 is used to receive the power provided by the power circuit 90 and convert the power provided by the power circuit 90 into a high-level excitation voltage Vs'. The power provided by the power circuit 90 may be the first DC voltage V1' outputted from the AC/DC converter 900 or the second DC voltage V2' outputted from the DC/DC converter 901. When the high-intensity discharge lamp Lp is operating in the transient state, the excitation voltage Vs' excites the high-intensity discharge lamp Lp. The ignition circuit 91 includes a switch element M and a transformer T'. The switch element M is connected in series with the primary winding Nf' of the transformer T', and the control terminal of the switch element M is used to receive a pulse signal (not shown). The secondary winding Ns' of the transformer T' is connected to the high-intensity discharge lamp Lp. When the pulse signal is in the enabling state and the switch element M is driven to turn on accordingly, the transformer T' converts the power received by the primary winding Nf' from the power circuit 90 and generates a high-level excitation voltage Vs' across the secondary winding Ns' to excite the high-intensity discharge lamp Lp. After the high-intensity discharge lamp Lp is excited, the pulse signal is transitioned to be in the disabling state or the pulse signal is stopped from being outputted to the control terminal of the switch element, thereby turning off the switch element M.

The ignition circuit 91 of the conventional electronic ballast 9 is able to excite the high-intensity discharge lamp Lp by the excitation voltage Vs'. Moreover, the pulse signal received by the switch element M of the ignition circuit 91 is a square wave and the time period for transitioning the pulse signal from the disabling state to the enabling state is very short. Therefore, the duration of the time period for transitioning the pulse signal d depends on the performance of the switch element M. Generally, the time period for transitioning the pulse signal from the disabling state to the enabling state is about tens of nanoseconds. However, the on-state time of the switch element M in the enabling state is tens of microseconds or longer. Hence, the transition of the switch element from the OFF state to the ON state will be considered instantaneous. In this way, the excitation voltage Vs' indicated by the curve S2 of FIG. 3 will have a considerable voltage jitter A2' as the switch element M is instantaneously transitioning from the OFF state to the ON state. Moreover, the peak voltage value A1' of the excitation voltage is about 6 KV, which exceeds the default safe voltage value. For example, the default safe voltage value, i.e. the voltage durability of lamp seat, is 5 KV. Thus, the longevity of the high-intensity discharge lamp Lp is shortened, and the lamp seat used for housing the high-intensity discharge lamp Lp may be burned out. Also, the voltage jitter A2' may not be able supply enough excitation energy to smoothly ignite the high-intensity discharge lamp Lp. In practical applications, the length of the output line connecting the electronic ballast 9 and the lamp seat may vary from case to case, and the parasite capacitance of the output line will affect the peak voltage value A1' and the voltage jitter A2' of the excitation voltage Vs', thereby incurring safety problems or deteriorating the ignition effect.

Although other types of the ignition circuit, such as the ignition circuit 8 shown in FIG. 4 which additionally places a capacitor C' connected in parallel with the discharge lamp Lp, or the ignition circuit 7 shown in FIG. 5 which additionally places an inductor L' connected in series with the primary winding Nf' of the transformer T', are used to reduce the peak voltage value and voltage jitter of the excitation voltage Vs' by the extrinsic capacitor C' or the extrinsic inductor L', the addition of the extrinsic element causes the dimensional enlargement of the electronic ballast or the ignition circuit and the increment of the manufacturing cost.

Hence, the inventors are mandatory to develop a method of controlling an ignition circuit and an electronic ballast applying such method to control the ignition circuit thereof, for the sake of resolving the aforementioned drawbacks and problems.

SUMMARY OF THE INVENTION

The major object of the invention is to provide a method of controlling an ignition circuit and the ignition circuit applying such method to address the above-mentioned deficiencies encountered by the prior art.

To this end, a first aspect of the invention is achieved by the provision of a method of controlling an ignition circuit to output an excitation voltage, wherein the ignition circuit is used to excite a discharge lamp and includes a transformer and a switch element which is connected to a primary winding of the transformer. The control method includes the steps of: (a) receiving a control signal to control an impedance of the switch element, wherein the control signal is set according to waveform output characteristics of a default excitation voltage; (b) controlling a primary current flowing through the primary winding of the transformer or a primary voltage across both sides of the primary winding of the transformer according to the impedance of the switch element; and (c) generating the excitation voltage by a secondary winding of the transformer according to the primary current or the primary voltage, thereby exciting the discharge lamp.

To this end, a second aspect of the invention is achieved by the provision of an ignition circuit for receiving a control signal and outputting an excitation voltage to excite a discharge lamp. The ignition circuit includes a switch element for receiving the control signal and having a variable impedance which is controlled by the control signal; and a transformer having a primary winding and a secondary winding, wherein the primary winding is connected to the switch element for controlling a primary current flowing through the primary winding or a primary voltage across the primary winding according to the impedance of the switch element, and the secondary winding is used to generate the excitation voltage according to the primary current or primary voltage to excite the discharge lamp, and wherein the control signal is set according to waveform output characteristics of the excitation voltage.

A third aspect of the invention is achieved by the provision of a method of controlling an ignition circuit to output an excitation voltage, wherein the ignition circuit includes a transformer and a switch element which is connected to a primary winding of the transformer. The method comprising the steps of: (a) outputting a control signal to drive the switch element to enter a saturation region for a rise time, wherein the ratio of the rise time to an overall on-state time of the switch element is equal to or larger than 1%; (b) regulating a primary current flowing through the primary winding of the transformer or a primary voltage across the primary winding of the transformer by the switch element; and (c) generating the excitation voltage by a secondary winding of the transformer according to the primary current or the primary voltage.

Now the foregoing and other features and advantages of the invention will be best understood through the following descriptions with reference to the accompanying drawings, wherein:

BRIEF DESCRIPTION OF THE DRAWINGS

FIG. 9 shows the equivalent circuit of the ignition circuit of FIG. 7 or FIG. 8 as the switch element is turned on;

DESCRIPTION OF THE PREFERRED EMBODIMENT

Several exemplary embodiments embodying the features and advantages of the invention will be expounded in following paragraphs of descriptions. It is to be realized that the present invention is allowed to have various modification in different respects, all of which are without departing from the scope of the present invention, and the description herein and the drawings are to be taken as illustrative in nature, but not to be taken as a confinement for the invention.

Figure 6:
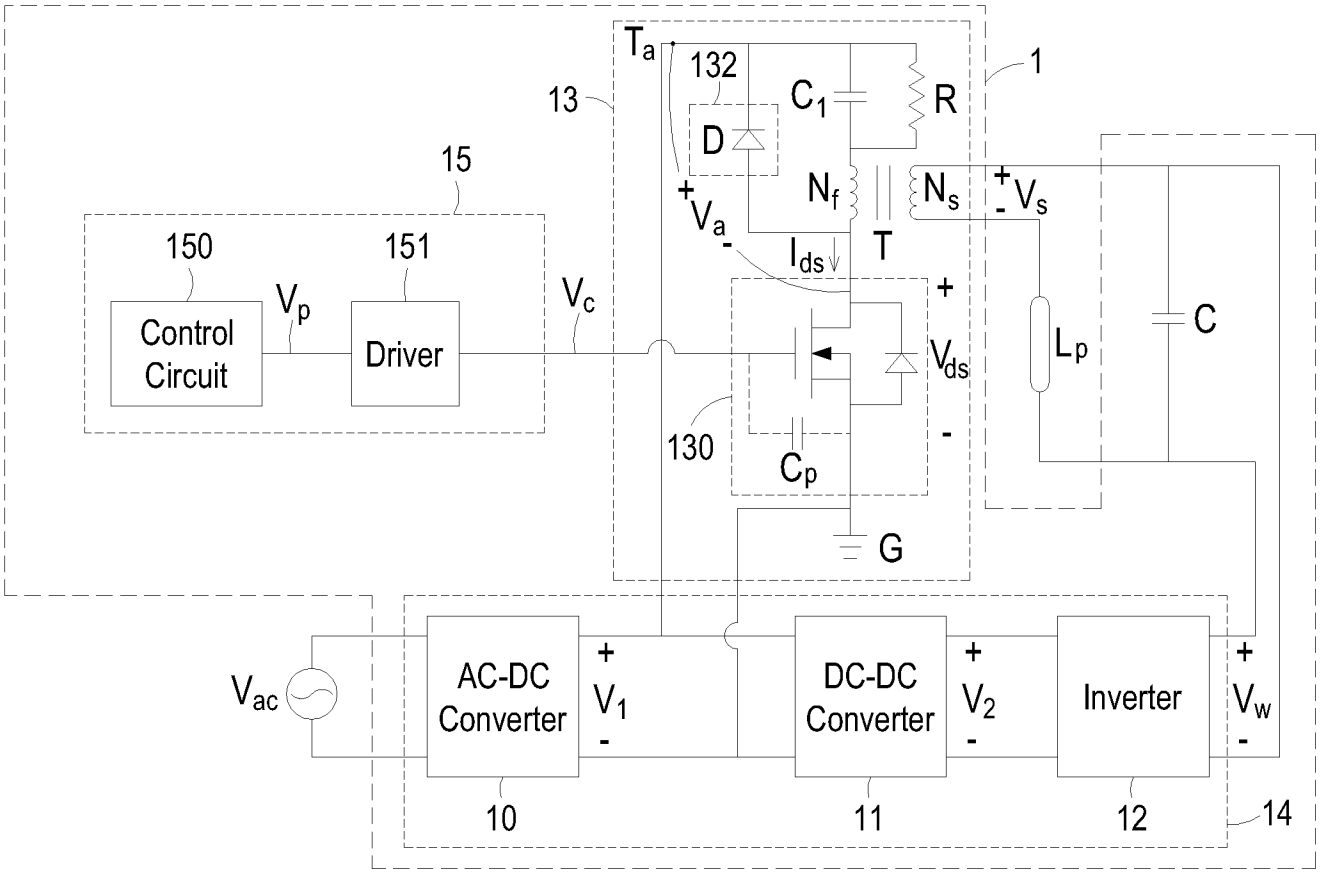
FIG. 6 is a circuit diagram showing the circuit structure of an electronic ballast according to an exemplary embodiment of the invention.

Referring to FIG. 6, which is a circuit diagram showing the circuit structure of an electronic ballast according to an exemplary embodiment of the invention. The electronic ballast is used to excite and power a lamp Lp, which may be a high-intensity discharge lamp and may be used indoors or outdoors or used as an illumination device for automobiles. The electronic ballast 1 includes an AC/DC converter 10, a DC/DC converter 11, an inverter 12, an ignition circuit 13, a control module 15, and a filter capacitor C. The AC/DC converter 10 and the inverter 12 form a converter circuit 14, and the AC/DC converter 10 is used to convert an AC voltage Vac into a first DC voltage V1. In this embodiment, the AC/DC converter 10 may possess the capability of performing power factor correction.

The DC/DC converter 11 is connected to the AC/DC converter 10 for converting the first DC voltage V1 into a second DC voltage V2. The inverter 12 is connected to the DC/DC converter 11 and the discharge lamp Lp for converting the second DC voltage V2 into an operating voltage Vw required to operate the discharge lamp Lp. Thus, the discharge lamp Lp is powered as the discharge lamp Lp is excited. Also, the inverter 12 may operate in low-frequency regions. For example, the operating frequency of the inverter 12 is 150 Hz in this embodiment. Therefore, the operating voltage Vw may be an AC voltage with a square waveform and a low frequency. Moreover, the AC/DC converter 10, the DC/DC converter 11, and the inverter 12 may be omitted or integrated. The filter capacitor C is connected to discharge lamp Lp and the inverter 12 of the converter circuit 14 for filtering the current outputted from the inverter 12.

A power input terminal of the ignition circuit 13 is connected to the converter circuit 14. For example, the ignition circuit 13 may be connected between the AC/DC converter 10 and the DC/DC converter 11 for receiving the first DC voltage V1, or may be connected between the DC/DC converter 11 and the inverter 12 for receiving the second DC voltage V2. The output end of the ignition circuit 13 is connected to the discharge lamp Lp for converting the first DC voltage V1 into an excitation voltage Vs. The excitation voltage Vs is used to excite the discharge lamp Lp. In the present embodiment, the ignition circuit 13 may include a transformer T, a switch element 130, a reset circuit 132, a bleeder resistor R, and a first capacitor C1.

The transformer T has a primary winding Nf and a secondary winding Ns, in which the primary winding Nf is connected in series between the first capacitor C1 and the switch element 130 and the secondary winding Ns is connected to the discharge lamp Lp. The transformer T is used to transfer the energy received by the primary winding Nf to the secondary winding Ns as the switch element 130 is ON, thereby generating the excitation voltage Vs across the secondary winding Ns. The switch element 130 is connected in series between the primary winding Nf and a ground terminal G. The control terminal of the switch element 130 is connected to the control module 15. The switch element 130 is controlled to turn on or off by the control module 15. In the present embodiment, the switch element 130 is implemented by a MOSFET. Hence, the drain of the switch element 130 is connected to the primary winding Nf; the source of the switch element 130 is connected to the ground terminal G; and the gate of the switch element 130 is connected to the control module 15. In alternative embodiments, the switch element 130 may be implemented by an isolated gate bipolar transistor (IGBT).

The first capacitor C1 is connected in series between the AC/DC converter 10 and the primary winding Nf. When the switch element 130 is ON, the first capacitor C1 is charged by the first DC voltage V1. The bleeder resistor R is connected in parallel with the first capacitor C1 for discharging the energy of the first capacitor C1 as the switch element 130 is OFF, thereby allowing the ignition circuit 13 to operate periodically.

Figure 10:
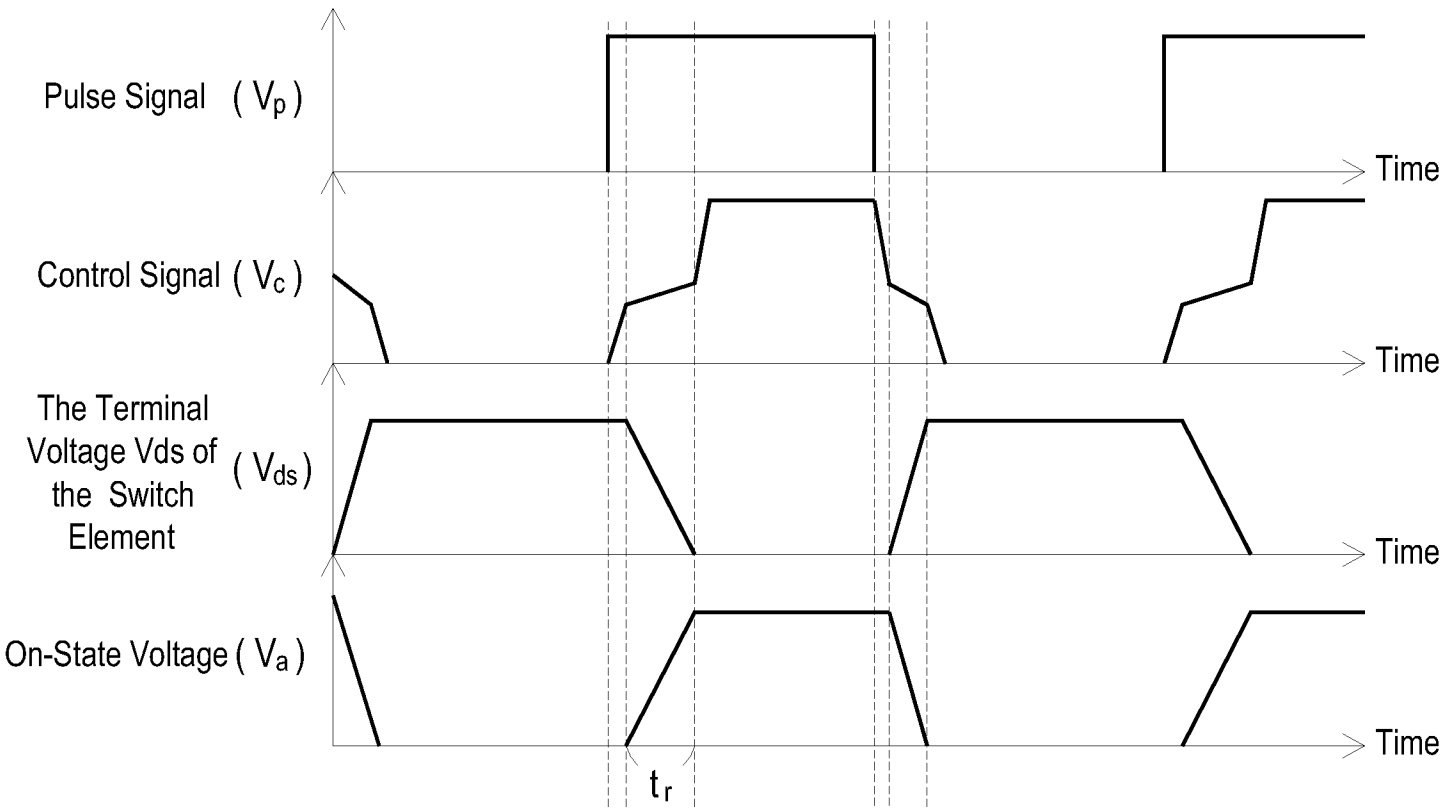
FIG. 10 shows the timing of the voltage signals applied in the electronic ballast of FIGS. 7 and 8.

The reset circuit 132 is connected in parallel across the series circuit consisted of the first capacitor C1 and the primary winding Nf for providing a discharge path for the primary winding Nf to discharge the energy of the primary winding Nf as the switch element 130 is OFF. In the present embodiment, the reset circuit 132 may be implemented by a diode D. The control module 15 is connected to the control terminal of the switch element 130 in the ignition circuit 13 for outputting a control signal Vc configurable to control the operation of the switch element 130. The control module 15 is used to drive the switch element 130 by the control signal Vc to operate in the saturation region (saturation is defined as the operation mode where $V_{gs}>V_{th}$ and $V_{ds}>V_{gs}-V_{th}$) for a rise time $t_r$ (as shown in FIG. 10) during the ON period, so as to allow the switch device 130 to function as a circuit element with variable impedance. Moreover, the impedance of the switch circuit 130 is controlled by the control signal Vc. That is, the impedance of the switch circuit 130 is the ratio of the terminal voltage Vds of the switch element 130, which is the voltage difference between the drain and the source of the switch element 130, to the on-state current Ids flowing through the switch element 130.

In the present embodiment, the control module 15 drives the switch element 130 by the control signal Vc to operate in the saturation region for a rise time $t_r$ during the ON period, and thus the switch element 130 functions as a circuit element with variable impedance. Therefore, the time period for pulling the on-state voltage Va from the low state to the high state is prolonged by a rise time $t_r$, and wherein the on-state voltage Va is transmitted to a first terminal Ta and the primary winding Nf through the switch element 130. Furthermore, the rise time $t_r$ is adapted by regulating the impedance of the switch element 130 by the control signal Vc, and thereby regulating the waveform characteristics of the excitation voltage Vs outputted from the ignition circuit 13. The waveform characteristics of the excitation voltage Vs to be regulated may be, for example, the peak voltage value and/or the voltage jitter. In alternative embodiments, the first terminal Ta may be the positive power input terminal of the ignition circuit 13.

Next, the detailed circuitry of the electronic ballast of FIG. 6 will be further described with reference to FIGS. 7 and 8. The symbols "a" and "b" labeled in FIGS. 7 and 8 are respectively matched with the positive power input terminal and the negative power input terminal of the ignition circuit 13 of FIG. 6, and the symbols "c" and "d" labeled in FIGS. 7 and 8 are respectively matched with the positive power output terminal and the negative power output terminal of the converter circuit 14 of FIG. 6.

Figure 7:
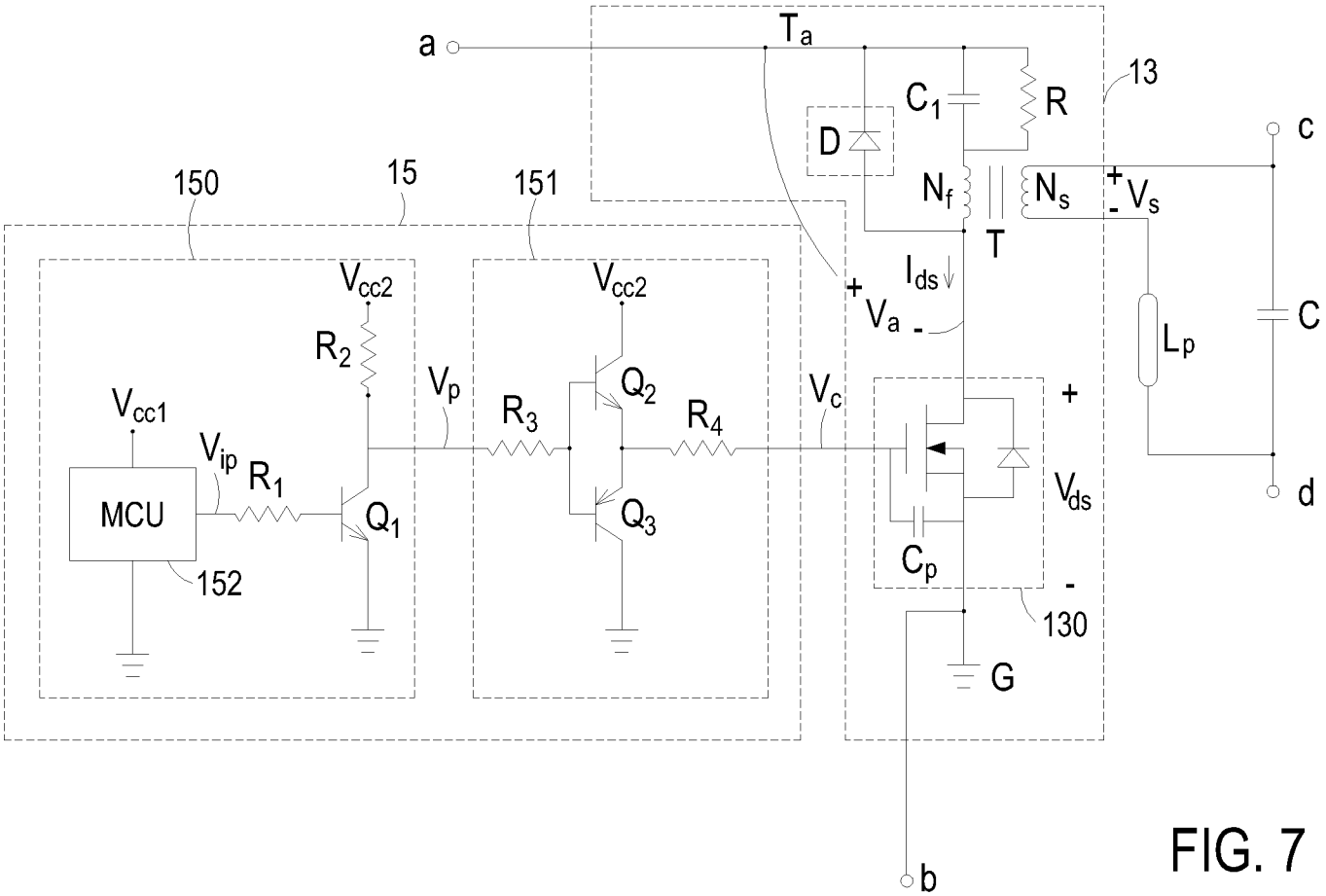
FIG. 7 shows the partial detailed circuitry of the electronic ballast of FIG. 6.
Figure 8:
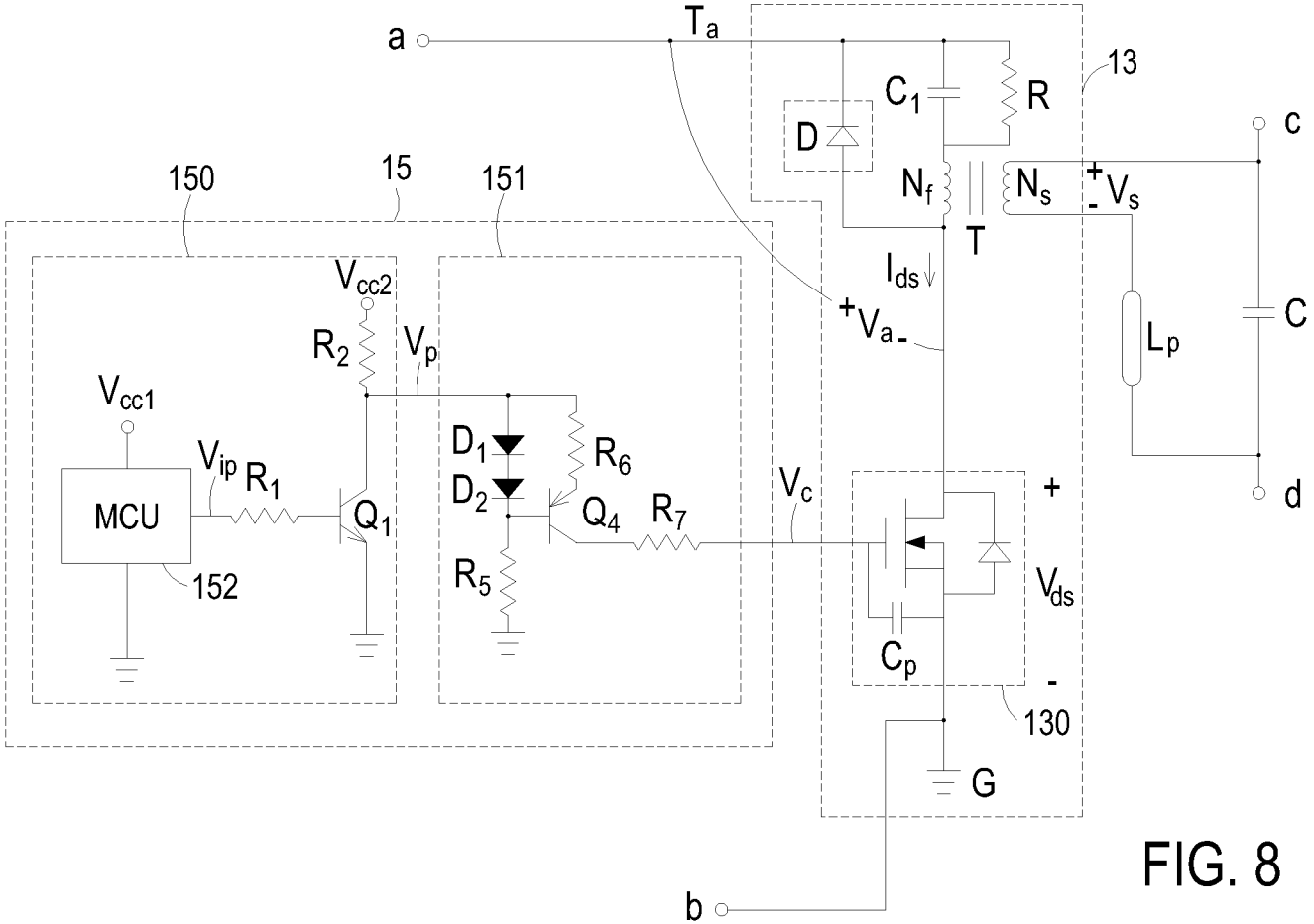
FIG. 8 shows the partial detailed circuitry of the electronic ballast according to another exemplary embodiment of the invention.

FIG. 7 shows the partial detailed circuitry of the electronic ballast of FIG. 6. As shown in FIG. 7, the control module 15 includes a control circuit 150 and a driver 151. The control circuit 150 is used to output a pulse signal Vp which may be an intermittent square wave. The control circuit 150 includes a micro-controller unit 152, a first resistor R1, a second resistor R2, and a first transistor switch Q1. The micro-controller unit 152 is connected to a first voltage source Vcc1 of 5 volts for outputting an internal pulse signal Vip with a variable voltage ranging between 0V and 5V. The first transistor switch Q1 may be implemented by a NPN-type BJT, whose collector is connected to one end of the second resistor R2 and the output end of the control circuit 150 and whose emitter is connected to the ground terminal G. The first resistor R1 is connected between the output end of the micro-controller unit 152 and the base of the first transistor Q1. The other end of the second resistor R2 is connected to a second voltage source Vcc2 of 15 volts. In this embodiment, the first resistor R1, the second resistor R2, and the first transistor switch Q1 constitute a level converter for amplifying the level of the internal pulse signal Vip outputted from the micro-controller unit 152 and thus outputting the pulse signal Vp with a variable voltage ranging between 0V and 15V.

The driver 151 is connected to the output end of the control circuit 150 and the control terminal of the switch element 130 for outputting the control signal Vc to control the operation of the switch element 130 according to the pulse signal Vp. The driver 151 includes a third resistor R3, a fourth resistor R4, a second transistor switch Q2, and a third transistor switch Q3. The second transistor switch Q2 may be implemented by a NPN-type BJT whose collector is connected to the second voltage source Vcc2. The third transistor switch Q3 may be implemented by a PNP-type BJT and constitutes a push-pull circuit with the second transistor switch Q2. The base of the third transistor switch Q3 is connected to the base of the second transistor switch Q2; the emitter of the third transistor switch Q3 is connected to the emitter of the second transistor switch Q2; and the collector of the third transistor switch Q3 is connected to the ground terminal G. The third resistor R3 is connected to the base of the second transistor switch Q2, the base of the third transistor switch Q3, and the output end of the control circuit 150. The fourth resistor R4 is connected to the emitter of the second transistor switch Q2, the emitter of the third transistor switch Q3, and the output end of the driver 151.

In this embodiment, the fourth resistor R4, the third resistor R3, the second transistor switch Q2, and the third transistor switch Q3 constitute a voltage-type driver to control the operation of the switch element 130. That is, as the pulse signal Vp is in enabling state, the second transistor switch Q2 is ON and the third transistor switch Q3 is OFF. Under this condition, the control terminal of the switch element 130 receives the second voltage source Vcc2 and the switch element 130 is turned on accordingly. On the contrary, as the pulse signal Vp is in disabling state, the second transistor switch Q2 is OFF and the third transistor switch Q3 is ON. Under this condition, the control terminal of the switch element 130 is connected to the ground terminal G and the switch element 130 is turned off accordingly.

In alternative embodiments, the resistance of the fourth resistor R4 may be ranged between 200Ω and 1000Ω. In this way, with the high resistance of the fourth resistor R4, the charging time for fully charging a parasite capacitance between the gate and the source of the switch element 130 as the switch element 130 is turned off will increase. When the control signal Vc drives the switch element 130 to turn on, the switch element 130 enters the saturation region and operates in the saturation region for a rise time $t_r$ instead of entering the linear region (linear region: $V_{GS}>V_{th}$ and $V_{DS}<V_{GS}-V_{th}$) immediately. Under this condition, the switch element 130 functions as a circuit element with variable impedance. Thus, the time period for pulling the on-state voltage Va from the low state to the high state is prolonged by a rise time $t_r$, and wherein the on-state voltage Va is transmitted to the first terminal Ta and the primary winding Nf through the switch element 130. Accordingly, the waveform characteristics of the excitation voltage Vs of the ignition circuit 13 can be regulated. For example, the peak voltage value of the excitation voltage Vs outputted from the ignition circuit 13 may be reduced (as indicated by the symbol A1 labeled in FIG. 12) and the voltage jitter of the excitation voltage Vs may be alleviated (as indicated by the symbol A2 labeled in FIG. 12).

FIG. 8 shows the partial detailed circuitry of the electronic ballast according to another exemplary embodiment of the invention. As shown in FIG. 8, the partial detailed circuitry of the electronic ballast of FIG. 8 is similar to the partial detailed circuitry of the electronic ballast of FIG. 7. Therefore, the characteristics and operation of the individual elements in the electronic ballast will not be repeated herein. Compared to FIG. 7, the driver 151 in this embodiment includes a fifth resistor R5, a sixth resistor R6, a seventh resistor R7, a fourth transistor switch Q4, a first biased diode D1, and a second biased diode D2. The fourth transistor switch Q4 may be implemented by PNP-type BJT, whose emitter is connected to the sixth resistor R6 and whose base is connected to the fifth resistor R5. The sixth resistor R6 is connected to the output end of the control circuit 150. The fifth resistor R5 is connected to the ground terminal G. The first biased diode D1 and the second biased diode D2 are connected in series between the output end of the control circuit 150 and the base of the fourth transistor switch Q4. The seventh resistor R7 is connected between the collector of the fourth transistor switch Q4 and the driver 151. The resistance of the seventh resistor R7 may be 33Ω.

In this embodiment, the fifth resistor R5, the sixth resistor R6, the seventh resistor R7, the fourth transistor switch Q4, the first biased diode D1, and the second biased diode D2 constitute a current-type driver for controlling the operation of the switch element 130. The output current of the current-type driver is $(2*V_f-V_{be})/R6$, where the voltage $V_f$ denotes the forward-biased voltage of the first biased diode D1 or the second biased diode D2, and the voltage $V_{bd}$ denotes the voltage drop across the base and the emitter of the fourth transistor switch Q4. It can be known that with the higher resistance of the sixth resistor R6, the current received by the control terminal of the switch element 130 will be reduced, thereby prolonging the time for fully charging the parasite capacitance Cp between the gate and the source of the switch element 130. As the control signal Vc drives the switch element 130 to turn on, the switch element 130 enters the saturation region and operates in the saturation region for a rise time $t_r$ as well instead of entering the linear region immediately (linear region; $V_{GS}>V_{th}$ and $V_{DS}<V_{GS}-V_{th}$). Under this condition, the switch element 130 functions as a circuit element with variable impedance. Thus, the time period for pulling the on-state voltage Va from the low state to the high state is prolonged by a rise time $t_r$, and wherein the on-state voltage Va is transmitted to the first terminal Ta and the primary winding Nf through the switch element 130. Accordingly, the waveform characteristics of the excitation voltage Vs of the ignition circuit 13 can be regulated. For example, the peak voltage value of the excitation voltage Vs outputted from the ignition circuit 13 may be reduced (as indicated by the symbol A1 labeled in FIG. 12) and the voltage jitter of the excitation voltage Vs may be alleviated (as indicated by the symbol A2 labeled in FIG. 12).

Figure 9:
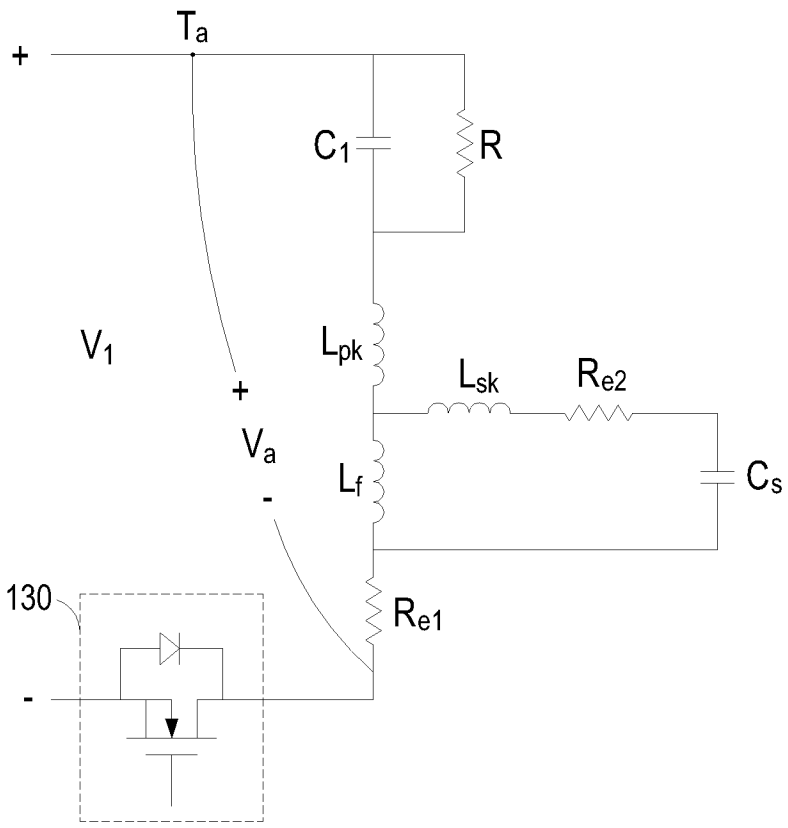

Referring to FIGS. 7, 8 and 9, in which FIG. 9 shows the equivalent circuit of the ignition circuit of FIG. 7 or FIG. 8 as the switch element 130 is turned on. As shown in FIG. 9, as the switch element 130 is turned on, the output end of the equivalent circuit of the ignition circuit 13 is provided with an equivalent output capacitance Cs. The output capacitance Cs may include the parasite capacitance of the discharge lamp Lp and the transformer T and the parasite capacitance of the cable connected to the discharge lamp Lp (not shown). The equivalent circuit of the ignition circuit 13 includes a first capacitor C1, a bleeder resistor R, a primary inductance Lf, an equivalent secondary leakage inductance Lsk, an equivalent primary leakage inductance Lpk, a first equivalent resistance Re1, and a second equivalent resistance Re2. The primary inductance Lf is formed by the primary winding Nf. The equivalent secondary leakage inductance Lsk is formed by the equivalent leakage inductance of the secondary winding Ns. The equivalent primary leakage inductance Lpk is formed by the equivalent leakage inductance of the primary winding Nf. The first equivalent resistance Re1 is the equivalent wire impedance of the primary winding Nf. The second equivalent resistance Re2 is the equivalent wire impedance of the secondary winding Nf. The on-state voltage Va between the first terminal Ta and the primary winding Nf is subject to change by the switching state of the switch element 130. That is, the on-state voltage Va between the first terminal Ta and the primary winding Nf is subject to change by the voltage drop across the drain and the source of the switch element 130 as the switch element 130 is turned on. In other words, the on-state voltage Va between the first terminal Ta and the primary winding Nf is subject to change by the change of the impedance of the switch element 130.

In FIG. 9, the capacitance of the first capacitor C1 may be 220 nF; the resistance of the bleeder resistor R may be 2.5 KΩ; the inductance of the primary inductance $L_f$ may be 30 μH; the inductance of the equivalent primary leakage inductance Lpk and the inductance of the equivalent secondary leakage inductance Lsk may both be 1 μH; the resistance of the first equivalent resistance Re1 may be 5Ω; and the resistance of the second equivalent resistance Re2 may be 0.3Ω. Also, the turn ratio of the primary winding Nf to the secondary winding Ns may be 10.

FIG. 10 shows the timing of the voltage signals applied in the electronic ballast of FIGS. 7 and 8. As shown in FIG. 10, as the pulse signal Vp is transitioned from the disabling state to the enabling state, the switch element 130 is turned on. As the control signal Vc drives the switch element 130 to operate in the saturation region for a rise time $t_r$ during the ON period, the switch element 130 becomes a circuit element with variable impedance. Thus, the terminal voltage Vds of the switch element 130 will not transition instantaneously from the high state to the low state. Instead, the drain-to-source voltage Vds of the switch element 130 will transition gradually from the high state to the low state during the rise time $t_r$. Also, the on-state voltage Va is the difference between the first DC voltage V1 and the terminal voltage Vds of the switch element 130. Hence, as the terminal voltage Vds is declining during the rise time $t_r$, the on-state voltage Va is rising during the rise time $t_r$.

Figure 11:
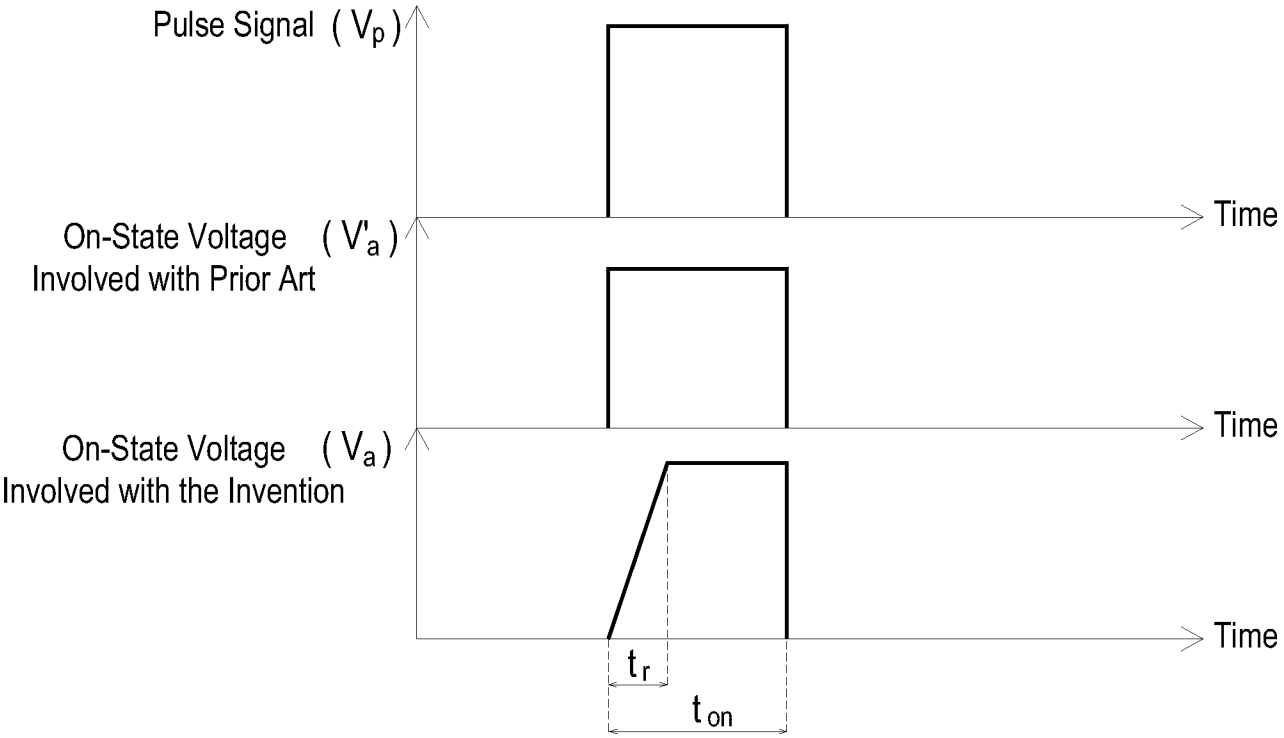
FIG. 11 shows the comparison of the signal timings and voltage timings involved with the invention and the signal timings and voltage timings involved with the prior art.

FIG. 11 shows the comparison of the signal timings and voltage timings involved with the invention and the signal timings and voltage timings involved with the prior art. As shown in FIG. 11, as the pulse signal Vp is transitioned from the disabling state to the enabling state, the on-state voltage Va' involved with the prior art is ascended instantaneously from the low state to the high state, which in turn renders the waveform characteristics of the excitation voltage Vs involved with the prior art unchangeable and renders the peak voltage value and the voltage jitter extra high. However, the invention employs the control signal Vc outputted from the control module 15 to drive the switch element 130 to enter the saturation region for a rise time $t_r$. Hence, the time period for the on-state voltage Va to be pulled from the low state to the high state is prolonged by a rise time $t_r$. Moreover, the duration of the rise time $t_r$ is determined by adapting the impedance of the switch element 130 through the setting of the control signal Vc. In this way, the waveform characteristics of the excitation voltage Vs outputted from the ignition circuit 13, such as the peak voltage values and/or voltage jitters, may be adapted accordingly.

Figure 1:
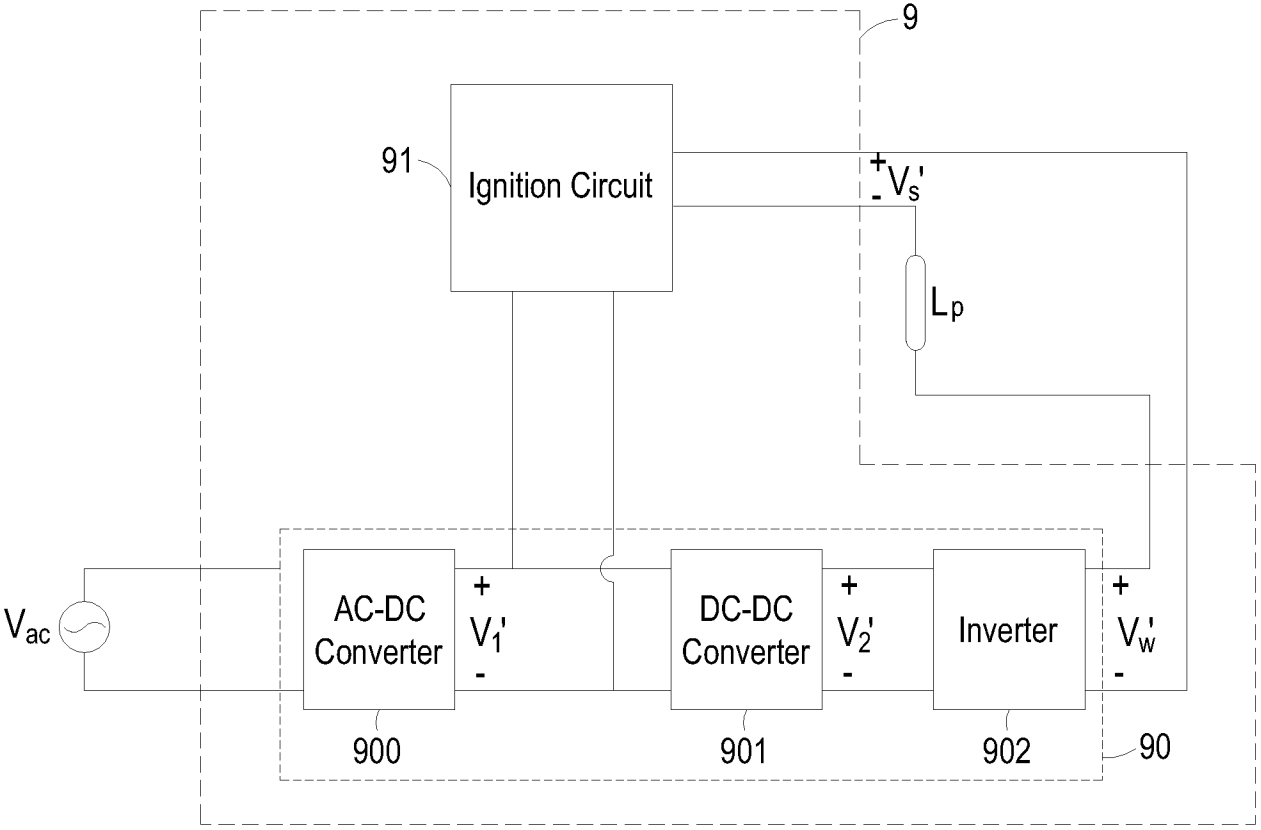
FIG. 1 (PRIOR ART)
FIG. 1 is a circuit block diagram showing an electronic ballast according to the prior art.
Figure 2:
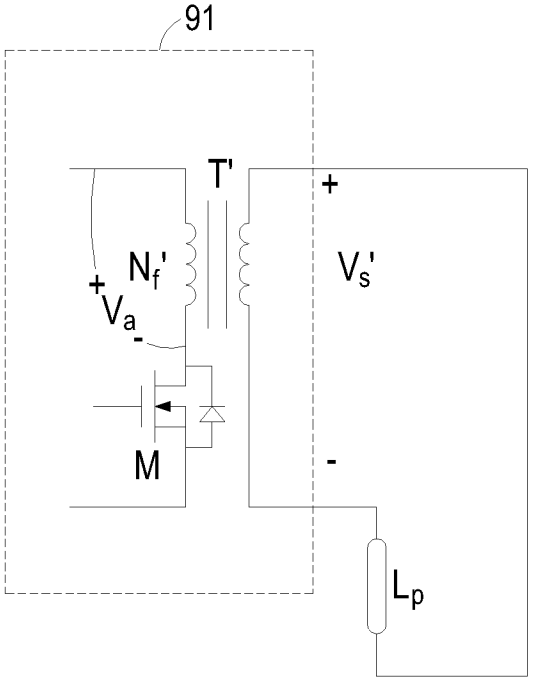
FIG. 2 (PRIOR ART)
FIG. 2 is a circuit diagram showing the circuit structure of the ignition circuit of FIG. 1.
Figure 3:
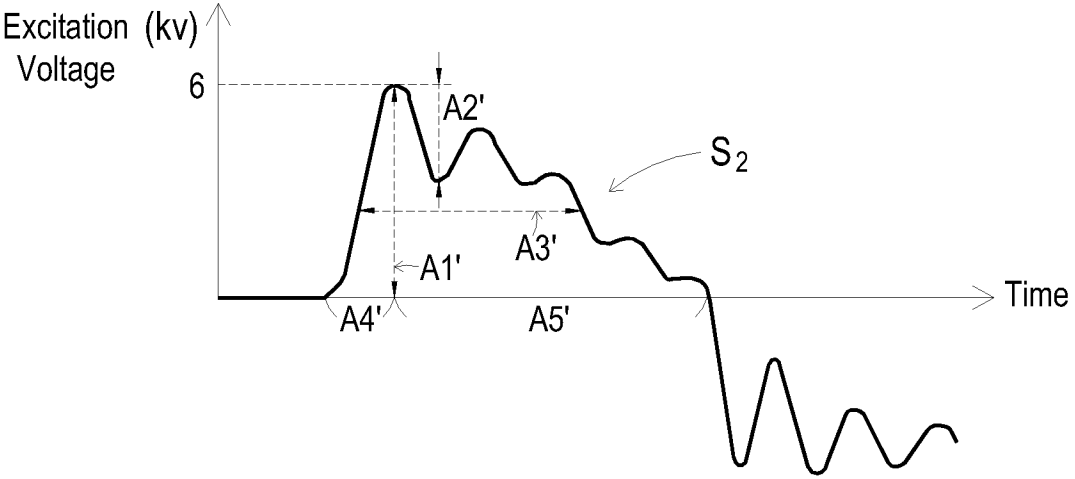
FIG. 3 (PRIOR ART)
FIG. 3 is a timing diagram showing the partially-zoomed excitation voltage according to the prior art.
Figure 5:
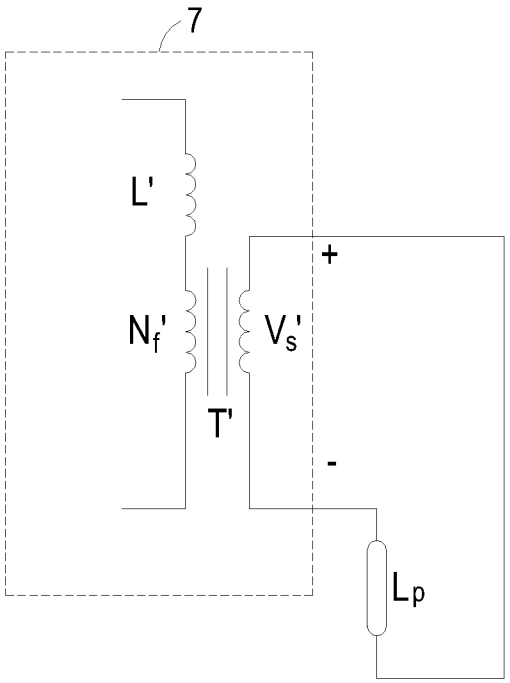
FIG. 5 (PRIOR ART)
FIG. 5 is a circuit diagram showing another type of the ignition circuit according to the prior art.
Figure 4:
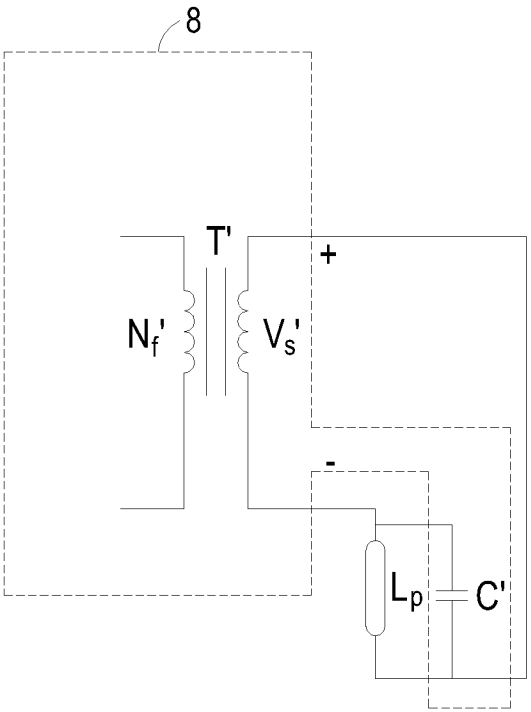
FIG. 4 (PRIOR ART)
FIG. 4 is a circuit diagram showing another type of the ignition circuit according to the prior art.
Figure 12:
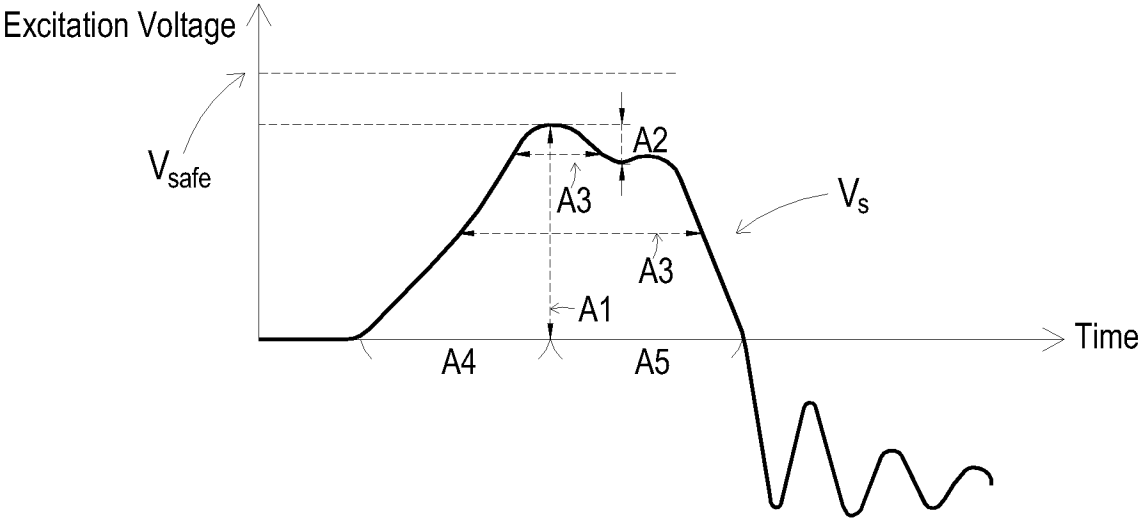
FIG. 12 is a timing diagram showing the partially-zoomed excitation voltage Vs of FIG. 6.

Referring to FIGS. 6-8 and 12, in which FIG. 12 is a timing diagram showing the partially-zoomed excitation voltage Vs of FIG. 6. As shown in FIG. 12, as the invention employs the control signal Vc outputted from the control module 15 to drive the switch element 130 to enter the saturation region for a rise time $t_r$, and thereby allowing the time period for the on-state voltage Va to be pulled from the low state to the high state to be prolonged by a rise time $t_r$, the peak voltage value A1 of the excitation voltage Vs is changed to be below a default safe voltage value Vsafe. Consequently, when the discharge lamp Lp is applied in a lamp seat, the lamp seat is not vulnerable to burnout. Besides, it can be known from FIG. 12 that the voltage jitter A2 of the excitation voltage Vs outputted from the ignition circuit 13 is smaller than the voltage jitter of the excitation voltage Vs' outputted from the conventional ignition circuit 9 as shown in FIG. 3. Hence, the reliability of the discharge lamp Lp is enhanced and the longevity of the discharge lamp Lp is prolonged. It can be known from FIG. 12 that the overall pulse width of the excitation voltage Vs outputted from the ignition circuit 13 is larger than the overall pulse width of the excitation voltage Vs' outputted from the conventional ignition circuit 9 as shown in FIG. 2. Thus, the invention can ensure enough energy to be supplied to the discharge lamp Lp to complete the ignition process smoothly.

In the present embodiment, the peak voltage value A1 and the pulse width A3 of the excitation voltage Vs are taken as the major criteria. The default safe voltage Vsafe of the peak voltage value is set at 5 KV. When the minimum voltage level of the excitation voltage Vs, e.g. 2.7 KV, is applied for exciting the discharge lamp Lp, the required pulse width A3 of the excitation voltage Vs is 1 μs.

As the rise time $t_r$ is getting longer, the peak voltage value A1 of the excitation voltage Vs is getting lower. However, the rise time $t_r$ will affect the pulse width A3 of the excitation voltage Vs. In order to allow the excitation voltage Vs to excite the discharge lamp Lp, the rise time $t_r$ must be appropriately set to allow the pulse width and the peak voltage value of the excitation voltage Vs to meet the practical requirements. Next, FIGS. 13-18 will be illustrated to elaborate the relationship among the rise time $t_r$ and the pulse width and peak voltage value of the excitation voltage Vs.

Figure 14:
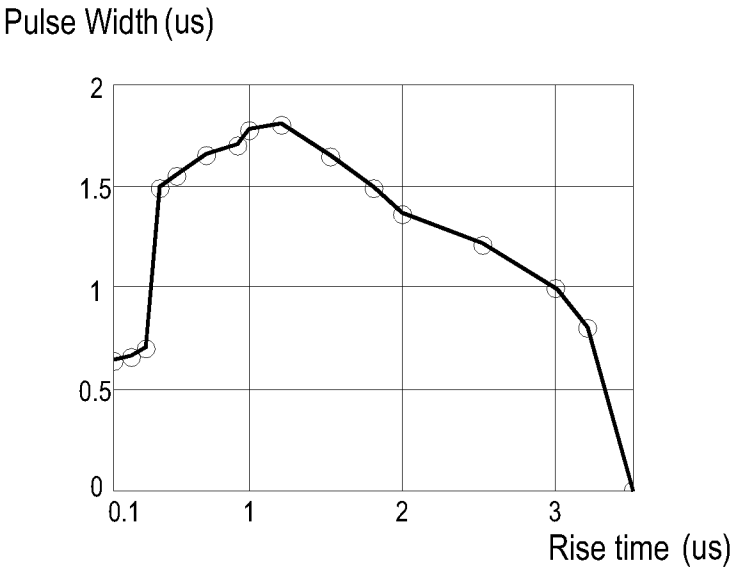
FIGS. 13 and 14 respectively show a timing diagram of the peak voltage value of the excitation voltage versus the rise time as the equivalent output capacitance of FIG. 9 is 10 nF and a timing diagram of the pulse width of the excitation voltage versus the rise time as the equivalent output capacitance of FIG. 9 is 10 nF.
Figure 13:
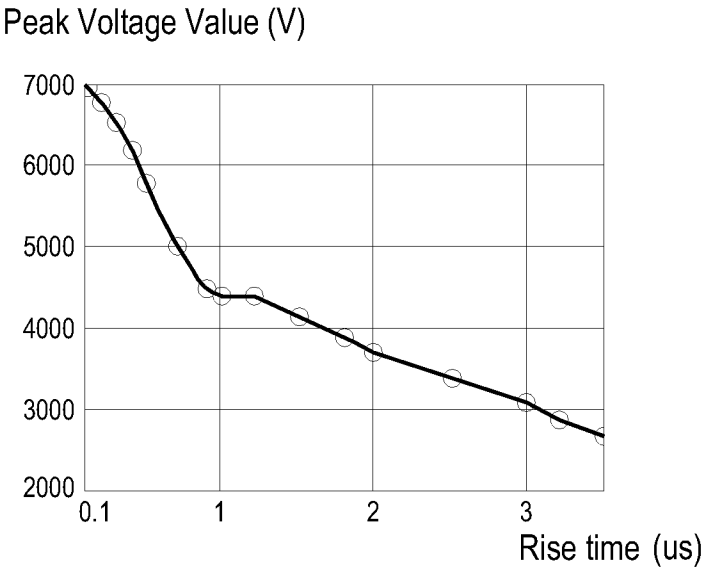
Figure 16:
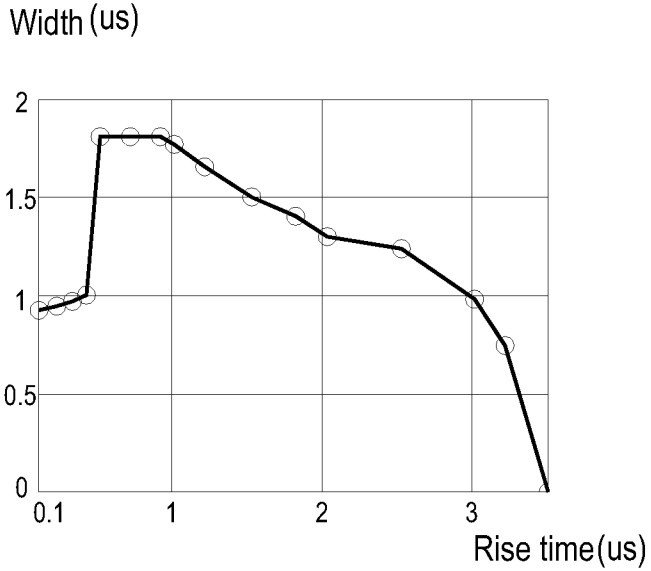
FIGS. 15 and 16 respectively show a timing diagram of the peak voltage value of the excitation voltage versus the rise time as the equivalent output capacitance of FIG. 9 is 20 nF and a timing diagram of the pulse width of the excitation voltage versus the rise time as the equivalent output capacitance of FIG. 9 is 20 nF.
Figure 15:
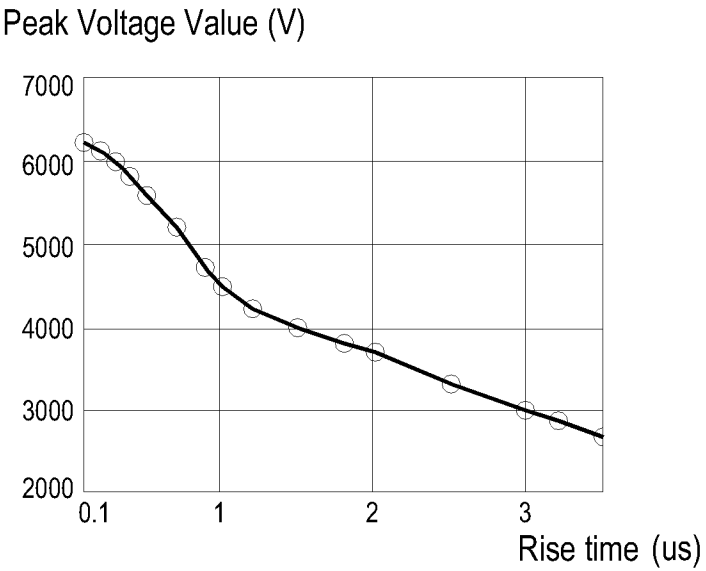
Figure 18:
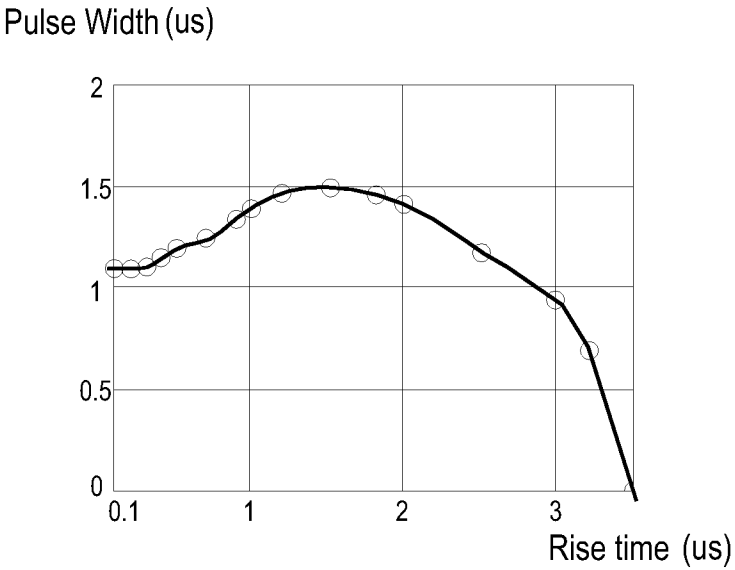
FIGS. 17 and 18 respectively show a timing diagram of the peak voltage value of the excitation voltage versus the rise time as the equivalent output capacitance of FIG. 9 is 30 nF and a timing diagram of the pulse width of the excitation voltage versus the rise time as the equivalent output capacitance of FIG. 9 is 30 nF.
Figure 17:
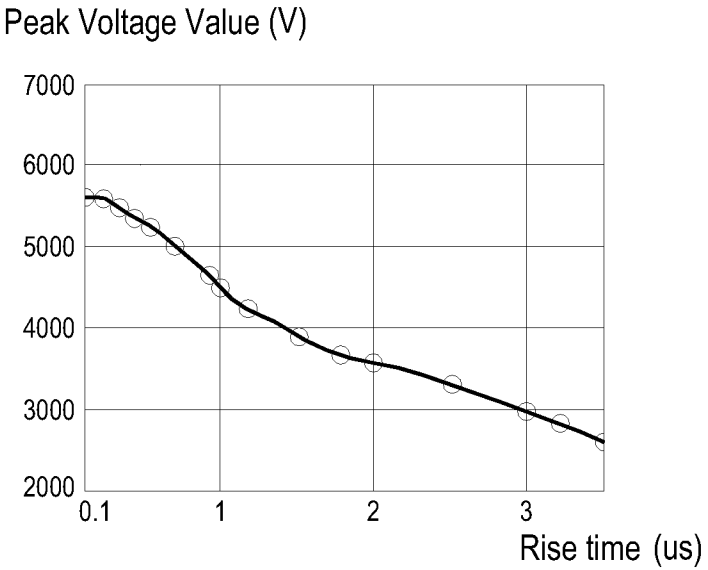

Referring to FIGS. 13 to 18, in which FIGS. 13 and 14 respectively show a timing diagram of the peak voltage value of the excitation voltage versus the rise time as the equivalent output capacitance of FIG. 9 is 10 nF and a timing diagram of the pulse width of the excitation voltage versus the rise time as the equivalent output capacitance of FIG. 9 is 10 nF, as is the case where the lamp seat is not connected to the output line or the output line is extremely short. FIGS. 15 and 16 respectively show a timing diagram of the peak voltage value of the excitation voltage versus the rise time as the equivalent output capacitance of FIG. 9 is 20 nF and a timing diagram of the pulse width of the excitation voltage versus the rise time as the equivalent output capacitance of FIG. 9 is 20 nF, as is the case where the output line is 1.5 m. FIGS. 17 and 18 respectively show a timing diagram of the peak voltage value of the excitation voltage versus the rise time as the equivalent output capacitance of FIG. 9 is 30 nF and a timing diagram of the pulse width of the excitation voltage versus the rise time as the equivalent output capacitance of FIG. 9 is 30 nF, as is the case where the output line is 3 m. As can be seen from these timing diagrams, as the rise time $t_r$ is getting longer, the peak voltage value of the excitation voltage Vs will be descending in a quasi-linear manner and the pulse width of the excitation voltage Vs will be varied non-linearly. With the appropriate setting of the rise time $t_r$, the peak voltage value and the pulse width of the excitation voltage Vs can meet practical requirements.

If the application range of output line (not shown) connecting the electronic ballast 1 and the discharge lamp Lp is 3 m, and if it is desired to allow the peak voltage value of the excitation voltage Vs to be lower than 5 KV in order to meet the requirements on the voltage durability of the lamp seat and allow the pulse width of excitation voltage Vs to reach its minimum value 1 μs as the minimum voltage level 2.7 KV of the excitation voltage Vs for exciting the discharge lamp Lp is applied, the rise time $t_r$ should be located between 0.8 μs and 3 μs and the optimal rise time $t_r$ should be located between 0.9 μs and 1.5 μs.

In the present embodiment, the first DC voltage V1 shown in FIG. 7 may be set at 500V and the discharge lamp Lp may be a ceramic metal halide lamp of 70 W. The switch element 130 may be implemented by a MOSFET product with model number SPP20N60CFD. The bleeder resistor R may be a resistor of 2.5 KΩ. The first capacitor C1 may be a capacitor of 220 Nf. The filter capacitor C may be a capacitor of 68 nF. The reset circuit may be implemented by a diode with model number MURS260T3. The primary winding Nf of the transformer T may consist of wires of 15 turns and the secondary winding Ns of the transformer T may consist of wires of 155 turns. The time period for driving the switch element 130 by the control signal Vc to operate in the saturation region is 1 μs.

Figure 19:
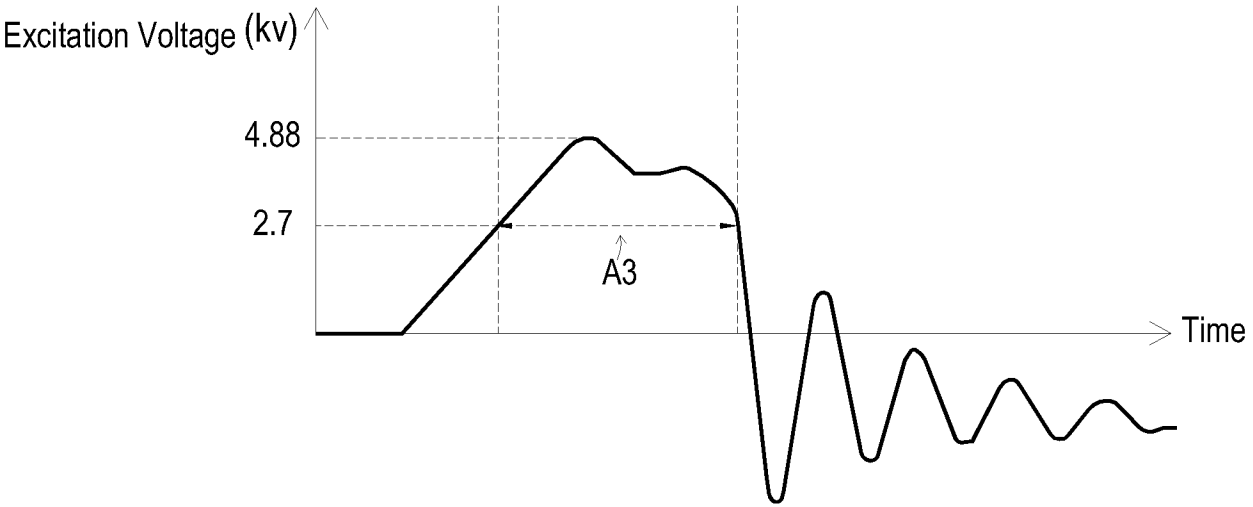
FIGS. 19 to 21 each show a timing diagram of the excitation voltage as the parasite capacitance on the output line connecting the electronic ballast and the lamp cover is 0 pF, 100 pF, and 200 pF, respectively.
Figure 20:
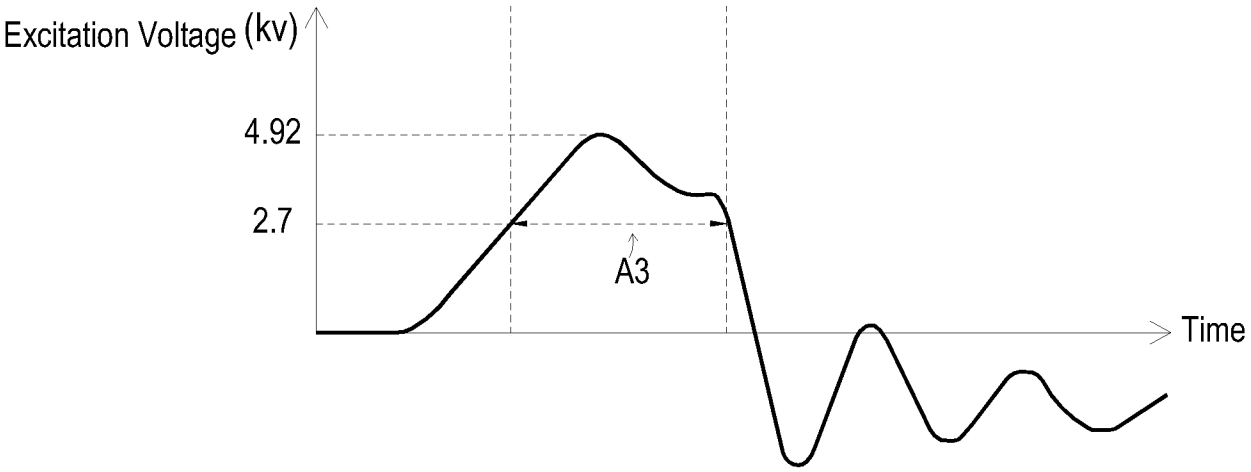
Figure 21:
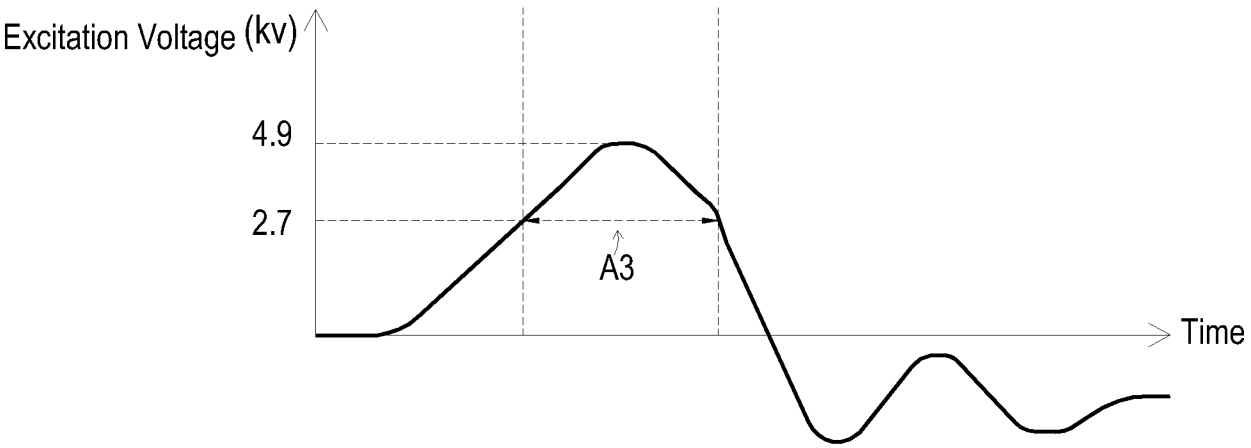

FIGS. 19 to 21 each show a timing diagram of the excitation voltage as the parasite capacitance on the output line connecting the electronic ballast and the lamp cover is 0 pF, 100 pF, and 200 pF, respectively. As the parasite capacitance on the output line is 0 pF, the peak voltage value of the excitation voltage Vs is 4.88 KV. Also, the required pulse width A3 of the excitation voltage Vs as the excitation voltage Vs reaches its minimum voltage level for exciting the discharge lamp Lp (such as 2.7 KV) is 1.38 μs. When the parasite capacitance on the output line Vs is 100 pF, the peak voltage value of the excitation voltage Vs is 4.92 KV. Under this condition, the required pulse width A3 of the excitation voltage Vs as the excitation voltage Vs reaches its minimum voltage level for exciting the discharge lamp Lp (such as 2.7 KV) is 1.29 μs. When the parasite capacitance on the output line Vs is 200 pF, the peak voltage value of the excitation voltage Vs is 4.9 KV. Under this condition, the required pulse width A3 of the excitation voltage Vs as the excitation voltage Vs reaches its minimum voltage level for exciting the discharge lamp Lp (such as 2.7 KV) is 1.15 μs.

Figure 22:
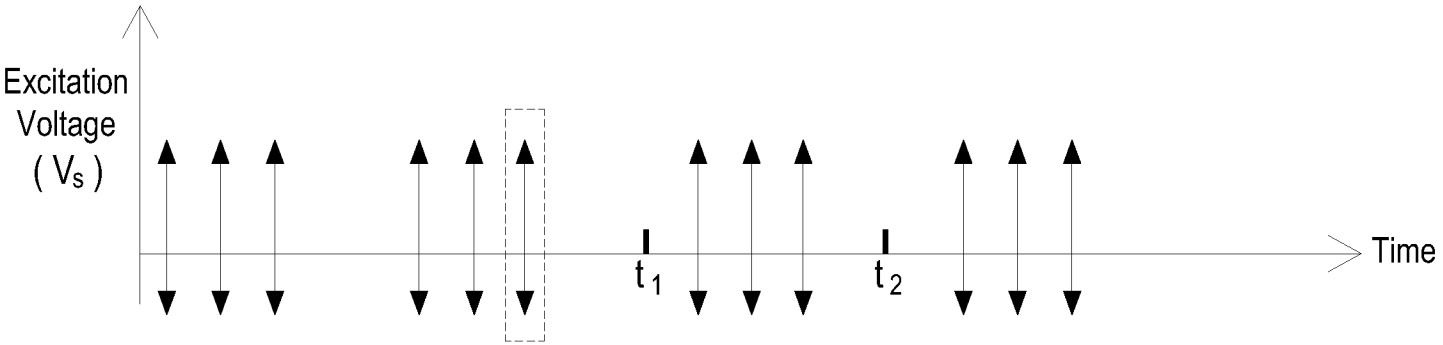
FIG. 22 is a timing diagram showing the relationship of the excitation voltage versus time according to the invention.

Referring to FIG. 22 and FIG. 12, in which FIG. 22 is a timing diagram showing the relationship of the excitation voltage versus time according to the invention. When the electronic ballast 1 starts operating, the ignition circuit 13 will periodically output an excitation voltage Vs to excite the discharge lamp Lp. As shown in FIG. 22, the ignition circuit 13 may output multiple excitation voltages Vs to excite the discharge lamp Lp in each ignition cycle. The period of the ignition cycle is the duration between the time t1 and the time t2. The waveform of the excitation voltage Vs is shown in FIG. 12. Besides, the embodiments of FIGS. 7 and 8 are two preferred embodiments of the invention only. As can be known from the above descriptions, the control module 15 is used to regulate the impedance of the switch element 130 to prolong the time period for pulling the on-state voltage Va from the low state to the high state by a rise time $t_r$. The regulation of the rise time $t_r$ may control the peak voltage value and the pulse width of the excitation voltage Vs. More advantageously, the regulation of the rise time $t_r$ may control other waveform characteristics of the excitation voltage Vs, for example, the voltage jitters (as shown by the designation mark A2 in FIG. 12), the rise time of excitation (as shown by the designation mark A4 in FIG. 12), the fall time of excitation (as shown by the designation mark A5 in FIG. 12), and the sum of the pulse widths within an ignition cycle. In this manner, the ignition circuit may accurately excite the discharge lamp Lp. For example, as the discharge lamp Lp is applied to the headlight of an automobile, the rise time of excitation of the excitation voltage Vs which is used for exciting the discharge lamp Lp must be at least 100 ns. Therefore, the rise time of excitation of the excitation voltage Vs may be fulfilling by regulating the duration of the rise time $t_r$.

Also, as the control single Vc drives the switch element 130 to enter the saturation and operate in the saturation for a rise time $t_r$ during the ON period, the charging current of the first capacitor C1 is limited by the impedance of the switch element and the current and voltage of the first capacitor C1 will be limited at a small value. As the switch element 130 is turned on and enters the saturation region, the current and voltage of the first capacitor C1 will continue increasing. Therefore, the ratio K1 of the rise time $t_r$ of the switch element 130 operating in the saturation region to the overall ON time (overall on-state time) $t_{on}$ of the switch element 130 (as shown in FIG. 11) is used to limit the voltage and current of the first capacitor C1. Hence, the first capacitor C1 may be implemented by a capacitor with small rated voltage. In alternative embodiments, the ratio K1 is limited to be equal to or larger than 1%. In preferred embodiments, the ratio K1 is limited at a range of 10% to 80%. For example, if the voltage received by the ignition circuit 13, such as the first DC voltage V1, is 500V, the first capacitor C1 should be implemented by a capacitor with a rated voltage of 1000V. Nevertheless, the ratio K1 is maintained around 50% according to the invention. As a result, the first capacitor C1 may be implemented by a capacitor with a rated voltage of 400V. More advantageously, the capacitor with a small rated voltage has a low cost and large size. Hence, the electronic ballast 1 or the ignition circuit 13 is substantially advantageous in terms of the small size and low cost of the first capacitor C1.

In conclusion, the invention contrives a method of controlling an ignition circuit and an ignition circuit applying such method. The invention employs a control signal outputted from a control module to regulate the impedance of the switch element to allow time period for pulling the on-state voltage from the low state to the high state to be prolonged by a rise time, where the on-state voltage is transmitted to a first terminal Ta and the primary winding Nf of the transformer through the switch element. Thus, the waveform characteristics of the excitation voltage, such as the peak voltage value and the voltage jitter, can be regulated. Therefore, the invention prolongs the longevity of the discharge lamp and satisfies the requirements on the voltage durability of the lamp seat without the need of connecting an extra capacitor in parallel with the discharge lamp and without the need of connecting an extra inductor in series with the primary winding of the transformer. Thus, the size and cost of the discharge lamp are reduced. Also, with the regulation of the duration of the rise time, the waveform characteristics of the excitation voltage can be regulated and the ignition circuit can excite the discharge lamp accurately.

While the invention has been described in terms of what are presently considered to be the most practical and preferred embodiments, it is to be understood that the invention need not be restricted to the disclosed embodiment. On the contrary, it is intended to cover various modifications and similar arrangements included within the spirit and scope of the appended claims which are to be accorded with the broadest interpretation so as to encompass all such modifications and similar structures. Therefore, the above description and illustration should not be taken as limiting the scope of the invention which is defined by the appended claims.

What is claimed is:

1. A method of controlling an ignition circuit to output an excitation voltage, wherein the ignition circuit is used to excite a discharge lamp and includes a transformer and a switch element which is connected to a primary winding of the transformer, the method comprising the steps of:

(a) receiving a control signal to prolong a rise time of a saturation region of the switch element for controlling an impedance, wherein the control signal is set according to waveform output characteristics of a default excitation voltage;

(b) controlling a primary current flowing through the primary winding of the transformer or a primary voltage across both sides of the primary winding of the transformer according to the impedance of the switch element; and (c) generating the excitation voltage by a secondary winding of the transformer according to the primary current or the primary voltage, thereby exciting the discharge lamp.

2. The method of controlling an ignition circuit according to claim 1 wherein the control signal is used to drive the switch element to enter the saturation region for a rise time during the on-state time.

3. The method of controlling an ignition circuit according to claim 2 wherein the rise time is dependent on the impedance of the switch element.

4. The method of controlling an ignition circuit according to claim 2 wherein the rise time is located between 0.8 μs and 3 μs.

5. The method of controlling an ignition circuit according to claim 4 wherein the rise time is located between 0.9 μs and 1.5 μs.

6. The method of controlling an ignition circuit according to claim 1 wherein the waveform output characteristics includes one or a combination of peak voltage values, pulse widths, voltage jitters, rise time of excitation, fall time of excitation, and the sum of the pulse widths within an ignition cycle.

7. The method of controlling an ignition circuit according to claim 2 wherein the control signal is set by forcing the rise time to comply with a default relationship of the rise time versus the waveform output characteristics of the excitation voltage.

8. An ignition circuit for receiving a control signal and outputting an excitation voltage to excite a discharge lamp, comprising:

a switch element for receiving the control signal and having a variable impedance which is controlled by the control signal; and a transformer having a primary winding and a secondary winding, wherein the primary winding is connected to the switch element for controlling a primary current flowing through the primary winding or a primary voltage across the primary winding according to the impedance of the switch element, and the secondary winding is used to generate the excitation voltage according to the primary current or primary voltage to excite the discharge lamp;

wherein the control signal is used to prolong a rise time of a saturation region of the switch element, and the control signal is set according to waveform output characteristics of the excitation voltage.

9. The ignition circuit according to claim 8 further comprising a control module which is connected to a control terminal of the switch element for outputting the control signal.

10. The ignition circuit according to claim 9 wherein the control module includes a control circuit for outputting a pulse signal.

11. The ignition circuit according to claim 10 wherein the control circuit includes a micro-controller unit and a level converter, wherein the micro-controller unit is connected to a first voltage source for outputting an internal pulse signal and the level converter is connected to the micro-controller unit for amplifying a level of the internal pulse signal to output the pulse signal, and wherein the level converter includes:

a first resistor connected to an output end of the micro-controller unit;

a second resistor connected to a second voltage source; and a first transistor switch having a base connected to the first resistor, a collector connected to the second resistor and an output end of the control circuit, and an emitter connected to a ground terminal.

12. The ignition circuit according to claim 10 wherein the control module further includes a driver for driving the control circuit and outputting the control signal according to the pulse signal, the driver comprising:

a third resistor connected to the output end of the control circuit;

a fourth resistor connected to an output end of the driver;

a second transistor switch having a base connected to the third resistor, a collector connected to the second voltage source, and an emitter connected to the fourth resistor; and a third transistor switch having a base connected to the third resistor, a collector connected to the ground terminal, and an emitter connected to the fourth resistor.

13. The ignition circuit according to claim 10 wherein the control module further includes a driver for driving the control circuit and outputting the control signal according to the pulse signal, the driver comprising:

a fifth resistor connected to a ground terminal;

a sixth resistor connected to the output end of the control circuit;

a seventh resistor connected to an output end of the driver;

a fourth transistor switch having a base connected to the fifth resistor, a collector connected to the seventh resistor, and an emitter connected to the sixth resistor; and a first biased diode; and a second biased diode connected in series with the first biased diode between the control end of the control circuit and the base of the fourth transistor switch.

14. The ignition circuit according to claim 8 further comprising:

a reset circuit connected to the primary winding of the transformer for forming a discharge path to reset the primary winding of the transformer as the switch element is turned off;

a first capacitor connected to the primary winding of the transformer for being charged as the switch element is turned on; and a bleeder resistor connected in parallel with the first capacitor for discharging energy of the first capacitor as the switch element is turned off, thereby allowing the ignition circuit to operate periodically.

15. The ignition circuit according to claim 14 wherein a voltage across the first capacitor is limited by regulating the on-state time of the switch element.

16. A method of controlling an ignition circuit to output an excitation voltage, wherein the ignition circuit comprises a transformer and a switch element which is connected to a primary winding of the transformer, the method comprising the steps of:

(a) outputting a control signal to drive the switch element to enter a saturation region for a rise time, wherein the ratio of the rise time to an overall on-state time of the switch element is equal to or larger than 1%;

(b) regulating a primary current flowing through the primary winding of the transformer or a primary voltage across the primary winding of the transformer by the switch element; and (c) generating the excitation voltage by a secondary winding of the transformer according to the primary current or the primary voltage.

17. The method of controlling an ignition circuit according to claim 16 wherein the ratio of the rise time to an overall on-state time of the switch element is equal to or larger than 10% and is smaller than 80%.

* * * * *